US006540627B1

(12) United States Patent
Leal et al.

(10) Patent No.: US 6,540,627 B1
(45) Date of Patent: Apr. 1, 2003

(54) ADJUSTABLE POWER BAT

(76) Inventors: Jose E. Leal, 116 Kirkland Dr., Stow, MA (US) 01775; John Barletta, 11 Nichols St., Southborough, MA (US) 01772

( * ) Notice: Subject to any disclaimer, the term of this patent is extended or adjusted under 35 U.S.C. 154(b) by 0 days.

(21) Appl. No.: 10/038,698

(22) Filed: Jan. 2, 2002

(51) Int. Cl.[7] ..... A63B 59/06
(52) U.S. Cl. ..... 473/564; 446/220
(58) Field of Search ..... 446/220–222, 446/224; 473/564–568, 519, 520, 457

(56) References Cited

U.S. PATENT DOCUMENTS

| | | | | | |
|---|---|---|---|---|---|
| 4,241,919 | A | * | 12/1980 | Foreman | 473/566 |
| 4,917,382 | A | * | 4/1990 | Hendershott | 473/567 |
| 5,144,708 | A | | 9/1992 | Pekar | |
| 5,150,897 | A | * | 9/1992 | Wortman | 473/567 |
| 5,380,002 | A | * | 1/1995 | Spector | 473/519 |
| 5,393,055 | A | | 2/1995 | MacKay, Jr. | |
| 5,421,572 | A | | 6/1995 | MacKay, Jr. | |
| 5,494,280 | A | | 2/1996 | MacKay, Jr. | |
| 5,620,179 | A | | 4/1997 | MacKay, Jr. | |
| 5,676,610 | A | | 10/1997 | Bhatt et al. | |
| 5,785,614 | A | | 7/1998 | MacKay, Jr. | |
| 5,785,617 | A | | 7/1998 | MacKay, Jr. | |
| 5,800,293 | A | | 9/1998 | MacKay, Jr. | |
| 5,827,142 | A | * | 10/1998 | Rappaport | 473/567 |
| 5,904,803 | A | | 5/1999 | Hillerich, III et al. | |
| 5,931,750 | A | | 8/1999 | MacKay, Jr. | |
| 5,961,405 | A | | 10/1999 | MacKay, Jr. | |
| 6,007,439 | A | | 12/1999 | MacKay, Jr. | |
| 6,010,435 | A | * | 1/2000 | Tanabe | 482/83 |
| 6,053,827 | A | | 4/2000 | MacKay, Jr. et al. | |
| 6,099,422 | A | * | 8/2000 | Rappaport et al. | 473/567 |
| 6,139,451 | A | | 10/2000 | Hillerich, III et al. | |

* cited by examiner

*Primary Examiner*—Mark S. Graham
(74) *Attorney, Agent, or Firm*—Joseph B. Bowman

(57) ABSTRACT

A children's baseball bat with a pressurizable, external hitting zone to selectively control the trampoline effect when a ball is struck by the bat. The hitting zone is provided by expandable tubing wrapped spirally around the barrel of the bat and connected to a manual air pump built into the handle of the bat to increase air pressure in the tubing. A pressure relief valve connected to the tubing allows the user to decrease air pressure in the hitting zone to control the trampoline effect or to decrease the circumference of the barrel.

10 Claims, 1 Drawing Sheet

ADJUSTABLE POWER BAT

BACKGROUND OF THE INVENTION

This invention relates to a baseball bat for children. More specifically, this invention relates to child-sized baseball bat that has a pressuizable, external hitting zone to selectively control the trampoline effect when a ball is struck by the bat. The invention also relates to a bat with an expandable external hitting zone which may be inflated to increase the circumference of the barrel to make hitting a ball easier.

Hitting a pitched ball with a bat has been often described as the most difficult feat in all of sports. The difficulty lies in the fact that both the thrown ball and the bat are round. To successfully hit a thrown ball, the batter must time his or her swing to meet the ball at the proper point in space and time. In addition, the ball should be struck along its center axis at or near the center axis of the barrel of the bat.

Children have a particularly difficult time learning to hit a ball with a bat. Lacking fully developed physical coordination, children struggle to master the timing necessary to hit a thrown ball. They may become dejected and move on to another sport. Even when they successfully time the swing of the bat to the velocity of the thrown ball, the results are not always positive. A ball hit above or below its center axis will travel a much shorter distance than one hit on its center axis. Correspondingly, if the bat contacts the ball too far away from the center axis of the barrel, the results will be equally unsatisfactory.

Another problem faced by children is limited availability of fields or lots in which to hone their hitting skills. Many children play in small backyards or fields adjoining buildings or streets. To the talented child, the challenge may not be in hitting the ball, but in not hitting it so far that it endangers nearby windows, pedestrians, or motorists.

Bats previously known in this art have used an internal bladder in the barrel to strengthen the bat or dampen vibrations caused when the bat strikes the ball. These bats provide no advantage to a child learning to hit a ball. They do not allow the child to increase the size of the barrel or hitting zone of the bat to make hitting a ball easier. They also do not allow control, either by increasing or decreasing, of the trampoline effect that occurs when the bat impacts a ball, which will correspondingly increase the distance the ball will travel when struck. A stronger bat has little usefulness to a child who is unable to hit a thrown ball. Similarly, a vibration dampening device only comes into play if the ball is struck with the bat. A child who is unable to master the feat of hitting will derive no benefit from such a device. In short, the added strength and vibration dampening provided by prior art bats offer little to the beginning batsman.

Nor do the prior art bats allow a child who is proficient at hitting a thrown ball to decrease the distance the ball will travel when struck. Such an adjustment will allow children of all levels to practice and play on small fields and lots where increased distance may be undesirable.

The need remains in the children's sporting goods industry for a bat that will help children to learn how to hit a pitched ball and at the same time reward less than perfect efforts. A need also remains for a bat that allows children to practice and play in small areas where a ball traveling a long distance will pose a safety risk. The primary objective of this invention is to meet these needs.

SUMMARY OF THE INVENTION

More specifically, an object of the invention is to provide a bat having a pressurizable, external hitting zone to selectively control the trampoline effect when a ball is struck by the bat. By adjustably controlling the trampoline effect through increasing or decreasing the pressure in the hitting zone, the distance a struck ball travels can be effectively controlled.

Another object of the invention is to provide a bat of the character described having a spirally wrapped exterior tubing around the barrel of the bat which may be adjustably pressurized to control the trampoline effect that occurs when the bat impacts a ball.

Another object of the invention is to provide a bat of the character described having spirally wrapped, expandable tubing around the barrel of the bat to define an exterior hitting zone which may be adjustably pressurized to vary the effective diameter of the bat.

A further object of the invention is to provide a bat having a hand-operated air pump built into the handle that allows convenient and efficient pressurization of the exterior hitting zone on the bat's barrel.

An additional object of the invention is to provide a bat having a pressure relief valve that allows the use to decrease the volume and/or pressure of air in the tubing wrapped exteriorly around the barrel, thereby decreasing the circumference of the barrel and/or the trampoline effect that occurs when the bat impacts a ball.

In summary, a children's baseball bat with a pressurizable, external hitting zone to selectively control the trampoline effect when a ball is struck by the bat. The hitting zone is provided by expandable tubing wrapped spirally around the barrel of the bat and connected to a manual air pump built into the handle of the bat to increase air pressure in the tubing. A pressure relief valve connected to the tubing allows the user to decrease air pressure in the hitting zone to control the trampoline effect or to decrease the circumference of the barrel.

Other and further objects of the invention, together with the features of novelty appurtenant thereto, will appear in the description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
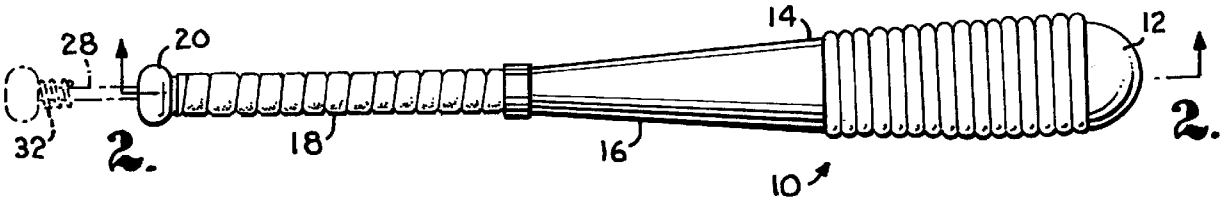
FIG. 1 is a side view of the adjustable power bat constructed in accordance with a preferred embodiment of the invention.
Figure 2:
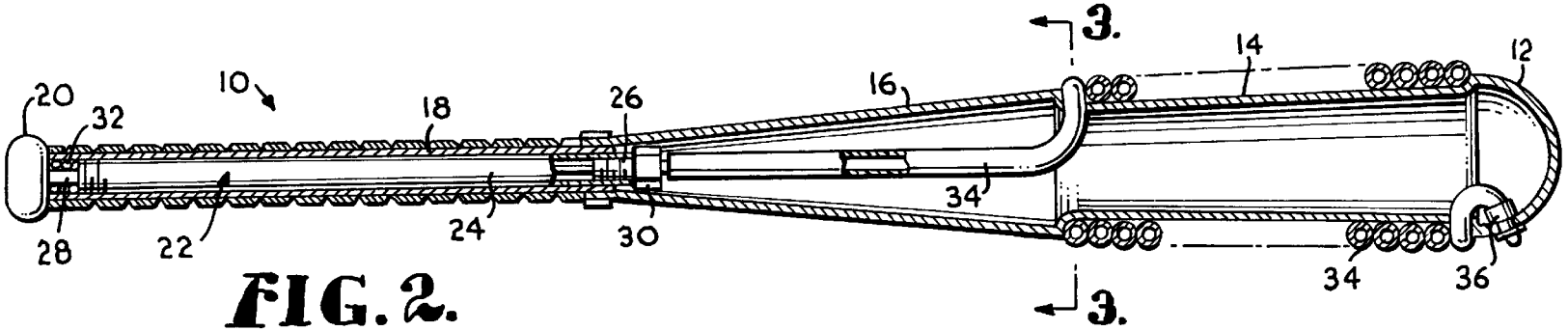
FIG. 2 is an enlarged sectional view taken along line 2—2 of FIG. 1 in the direction of the arrows.
Figure 3:
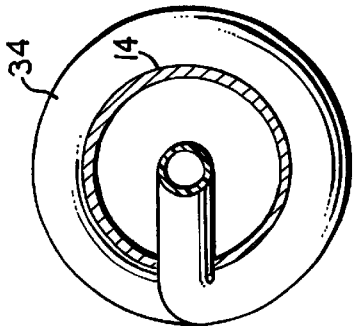
FIG. 3 is an enlarged sectional view taken along line 3—3 of FIG. 2 in the directions of the arrows.

Referring to the drawings in greater detail, attention is first directed to FIGS. 1 & 2. The adjustable power bat, generally designated by the numeral 10, has a hollow interior and is comprised of an upper end cap 12, a barrel 14, a tapered transition section 16, a handle section 18, and an end knob 20. The end cap 12 closes one end of the barrel 14. At the end of the barrel 14 opposite the end cap 12, the barrel is affixed to the larger diameter end of the tapered transition section 16. Intermediate its ends, the diameter of the barrel 14 is reduced to create a channel throughout the length of the barrel 14. For example, reducing the diameter of the barrel 14 by approximately ½ inch from the adjacent end cap 12 and larger end of the transition section 16 creates a channel of approximately ¼ inch deep around the entire barrel 14.

The tapered transition section 16 interconnects the barrel 14 and the handle 18. In the illustrated embodiment, the handle 18 is molded with circumferentially cut grooves to provide grip enhancement Other structural features could be used, however, to provide an enhanced gripping surface, such as tape wrapped exteriorly around a smooth handle section.

A hand-operated air pump 22 is housed within the handle 18. The air pump 22 is comprised of a tubular air cylinder 24, a piston plunger 26, a piston rod 28, and a check valve 30. The piston rod 28 is connected at its inner end to the piston plunger 26. The outermost end of the piston rod 28 extends beyond the tubular air cylinder 24 and the handle 18 where it attaches to a bulbous knob 20. A spring 32 encircles the piston rod 26 to be carried thereon between the knob 20 and the air cylinder 24.

As seen in FIG. 2, the innermost end of the tubular air cylinder 24 is fitted with a check valve 30. The check valve 30 is connected to one end of flexible tubing or air hose 34. The check valve 30 allows air to pass into the air hose 34, but not return to the tubular air cylinder 30. The air hose 34 passes interiorly of the bat through the tapered transition section 16 and then out through a hole in the barrel 14 which is approximately the same diameter as the diameter of the tubing 34. The air hose 34 wraps spirally around the exterior of the barrel 14 and then passes back into the interior of the bat through a hole in the barrel 14 adjacent the end cap 12 which is approximately the same diameter as the diameter of the tubing 34. Thus, the successive wraps of the air hose 34 lie adjacent to each other to form a coil that extends throughout the entire length of the recessed channel which forms the barrel 14 of the bat.

The end of the air hose 34 terminates with a connection to a pressure relief valve 36 mounted in the end cap 12. The pressure relief valve 36 includes a manually depressible button in order to bleed pressure from the air hose 34.

The tubing material used to fabricate the air hose 34 for use in this invention may influence the properties of the resulting bat construction. Of course, the tubing must be flexible in order to spirally cover the barrel section 14 of the bat. One type of suitable tubing material for this invention, however, has little or no expandability when under pressure. Thus, a bat construction utilizing such material would achieve selective control of the trampoline effect when a ball is struck by the bat by simply varying the air pressure within the tubing 34. In other words, the tubing itself would not vary substantially in circumferential size but could be made more rigid by control of the air pressure within the tubing 34.

On the other hand, another type of suitable tubing material for this invention can expand when under pressure. Thus, for a bat construction utilizing such expandable material, air pressure could be used to increase the circumferential size of the hitting zone through inflation of the expandable tubing 34, in addition to achieving selective control of the trampoline effect when a ball is struck by the bat with the varying air pressure. In other words, increasing air pressure with the tubing 34 could cause an increase in the size of the tubing, as well as causing the tubing to become more rigid.

In operation, the user of the adjustable power bat 10 pulls the knob 20 away from the handle 18. When the user pushes the knob 20 back toward the handle 18, the piston plunger 26 forces air from the tubular air cylinder 24, through the check valve 30 and into the tubing 24 to increase the air pressure within the tubing. Air is prevented from returning from the tubing 34 back into the air cylinder 24 of the pump 22 by the check valve 30. Depending upon the material of fabrication used for the tubing 34, as previously noted, the rigidity of the tubing will increase with increasing air pressure or both the size and rigidity of the tubing will increase with increasing air pressure. In either event, the trampoline effect of the bat will increase with increasing air pressure. With an expandable material used for fabrication of the tubing 34, the circumferential size of the hitting zone may also increase with increasing air pressure.

The pressure relief valve 36 may be depressed in order to decrease the air volume and/or pressure in the tubing 34 in order to decrease the trampoline effect by rendering the tubing less rigid and, when an expandable material is used for fabrication of the tubing 34, to also decrease the circumferential size of the barrel 14 which forms the hitting zone.

Constructed and operated as previously described, the adjustable power bat achieves the goals and objections previously set forth. The invention provides a children's bat having a pressurizable, external hitting zone to selectively control the trampoline effect when a ball is struck by the bat. Even for a youngster, therefore, the bat appears to have added power when pressurized and, by adjustably controlling the trampoline effect through increasing or decreasing the pressure in the hitting zone, the distance a struck ball travels can be effectively controlled. Depending on the material selected for fabrication of the tubing used in the bat construction, the exterior hitting zone may be adjustably pressurized to vary the effective diameter of the bat. Pressurization and pressure release are easily and conveniently accomplished with the self contained air pump housed within the handle of the bat and the relief valve.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

NUMERALS adjustable power bat 10
end cap 12
barrel 14
tapered transition section 16
handle 18
knob 20
hand-operated air pump 22
tubular air cylinder 24
piston plunger 26
piston rod 28
check valve 30
spring 32
tubing or air hose 34
pressure relief valve 36

Having thus described my invention, I claim:

1. A children's ball bat for striking a ball, said bat comprising:

a handle section;

a barrel joined to said handle section;

continuous pressure tubing wrapped exteriorly around at least a portion of said barrel to define a ball hitting zone; and a pressure fluid source connected to said tubing for selectively introducing and pressurizing fluid to said tubing for varying the impact compressibility of said tubing to control the trampoline effect associated with said ball hitting zone striking a ball.

2. The bat as in claim 1 further including a selectively operable, pressure relief valve connected to said tubing to release pressurizing fluid from said tubing.

3. The bat as in claim 1 further including a hollow, interior recess for housing said pressure fluid source therein.

4. The bat as in claim 1, said barrel including a recessed channel portion to receive successive coils of said tubing wrapped spirally around said barrel within said channel portion to define said ball hitting zone.

5. The bat as in claim 1, said tubing being fabricated from substantially nonexpandable material such that said pressure fluid source connected thereto varies the impact compressibility of said tubing without substantially affecting the size of said tubing to thereby control the trampoline effect associated with said ball hitting zone striking a ball.

6. The bat as in claim 1, said tubing being fabricated from pressure expandable material such that said pressure fluid source connected thereto varies both the impact compressibility of said tubing and the effective diameter of said tubing to thereby control both the trampoline effect associated with said ball hitting zone striking a ball and the overall circumferential size of said ball hitting zone.

7. The bat as in claim 1, said pressure fluid source comprising an air pump equipped with a one way check valve connected to said pressure tubing for selectively introducing and pressurizing air to said tubing.

8. The bat as in claim 7, said air pump including an air cylinder substantially housed within the interior of said bat, a piston plunger received within said air cylinder and a piston rod connected to said plunger, said piston rod having an end extending from said bat and manually operable with successive reciprocating strokes to pump pressurizing air into said tubing.

9. The bat as in claim 8 including a bulbous knob connected to the end of said piston rod extending from said bat to facilitate manual operation of said air pump.

10. The bat as in claim 2 including an end cap connected to said barrel and closing the end of said bat in which said pressure relief valve is mounted for manual depression to release pressure fluid from said tubing.

* * * * *